US006088565A

United States Patent [19]

Jia et al.

[11] Patent Number: 6,088,565

[45] Date of Patent: Jul. 11, 2000

[54] BUFFERED TRANSFUSE SYSTEM

[75] Inventors: Nancy Y. Jia, Webster; Gerald M. Fletcher, Pittsford; John S. Berkes, Webster; Kim S. Buell, Sodus, all of N.Y.

[73] Assignee: Xerox Corporation, Stamford, Conn.

[21] Appl. No.: 09/219,695

[22] Filed: Dec. 23, 1998

[51] Int. Cl.[7] ..... G03G 15/16; G03G 15/20

[52] U.S. Cl. ..... 399/302; 399/307

[58] Field of Search ..... 399/299, 300, 399/302, 307, 308

[56] References Cited

U.S. PATENT DOCUMENTS 5,410,392 4/1995 Landa ..... 399/308

5,737,678 4/1998 Volkers et al. ..... 399/302

5,805,967 9/1998 De Bock et al. ..... 399/299

FOREIGN PATENT DOCUMENTS 63-34572 2/1988 Japan .

*Primary Examiner*—Joan Pendegrass

[57] ABSTRACT

Toner image forming stations form toner images that are electrostatically transferred to the intermediate transfer member. The composite toner image is transferred to the transfuse member at the second transfer nip. The temperature of the transfuse member in the second transfer nip is above the glass transition temperature of the toner image. The toner image is generally transferred and fused to the substrate in the third transfer nip.

19 Claims, 10 Drawing Sheets

BUFFERED TRANSFUSE SYSTEM

FIELD OF THE INVENTION

This invention relates to electrostatographic printing machines, and more particularly this invention relates to a buffered electrostatographic printing machine having transfuse of a toner image to a substrate.

BACKGROUND TO THE INVENTION

Electrostatographic printers are known in which a single color toner image is electrostatically formed on photoreceptive image bearing member. The toner image is transferred to a receiving substrate, typically paper or other print receiving materials. The toner image is subsequently fused to the substrate.

In other electrostatographic printers a plurality of dry toner imaging systems, one image bearing member is used to develop multiple color toner images. Each color toner image is electrostatically transferred in layers from the image bearing members and registered to an intermediate transfer member. The composite toner image is electrostatically transferred to the final substrate. Such systems that use electrostatic transfer to transfer the composite toner image from the intermediate to the final substrate and then subsequently fix the image on the substrate in a fusing system have transfer limitations. For example, there are limitations due to stresses introduced with rougher paper stock, foils, paper moisture content variations, etc. Also, the need to electrostatically transfer a full layered color composite toner image to the substrate creates additional high stresses for electrostatic transfer. Stressful system conditions can include for example systems that may wish to use papers allowed to condition at wide ranges of relative humidity, and systems that may wish to image onto a large range of paper widths. Such stresses can have significant effect on transfer due to the effect on the electrostatic fields used in electrostatic transfer, and they can also have significant effect on paper transport. In addition with direct to paper transfer, fibers, talc and other particulate or chemical contaminants can readily directly transfer from the paper to the imaging modules during direct contact in the electrostatic transfer zones. This can tend to contaminate the imaging drums, development systems, cleaner systems, etc., and can lead to early failure of the imaging systems. This is especially true for certain stressful paper types including for example certain types of recycled papers. Due to all these and other problems, systems that use direct transfer to the final media generally have narrow media latitude for obtaining and/or for maintaining high print quality.

Alternatively, a toner image is formed on a photoreceptor. The toner image is transferred to a single transfer member. The transfer member generally simultaneously transfers and fuses the toner image to a substrate. The use of a single transfer member can result in transfer of background toner on the photoreceptor to the substrate due to the material of the transfuse member. In addition, the photoreceptor can be contaminated by heat and oil on the transfuse member from the transfuse nip.

To overcome some of the deficiencies of the single transfer, prior systems have employed two transfer belts. Toner images are formed on photoreceptors and transferred to a first transfer belt. The toner image is subsequently transferred to a second transfer member. The second transfer member is cooled below the glass transition temperature of the toner prior to the transfer nip with the first transfer belt. Cooling of the second transfer belt requires the second transfer member to be relatively thin. A thin second transfer belt however has low conformance therefore providing reduced transfer efficiency in the transfuse nip. The reduced conformance also increases the potential for glossing of the toner image in the transfuse nip. In addition, a thin second transfer belt can have a reduced operational life.

SUMMARY OF THE INVENTION

Briefly stated, an electrostatographic printing machine in accordance with the invention has multiple toner image producing stations, each forming a developed toner image of a component color. The developed toner images are electrostatically transferred at the first transfer nip to an intermediate transfer member to form a composite toner image thereon. The composite toner image is then transferred electrostatically and with rheological assist at the second transfer nip to a transfuse member. The transfuse member preferably has improved conformability and other properties for improved transfusion of the composite toner image to a substrate. The second transfer member is maintained above the glass transition temperature of the composite toner image at the second transfer nip. The composite toner image and the substrate are brought together in the third transfer nip to generally simultaneously transfer the composite toner image and fuse the composite toner image to the substrate to form a final document.

The use of an intermediate member allows electrostatic transfer in the first transfer nip to suppress transfer of background toner from the image bearing member. The intermediate transfer member can be selected to have a low affinity for receiving background toner.

The intermediate transfer member buffers the image bearing member from the third transfer nip. In particular, the intermediate transfer member can buffer the image bearing member from release oils on the transfuse member. The release oils can be inherent in the topmost layer of the transfuse member, such as silicone as a top most layer, and/or can be applied to the transfuse member by a release agent management system.

In addition the intermediate transfer member thermally isolates the image bearing member from the heat of the transfuse member. Therefore the transfuse member can operate at a relatively higher temperature without the potential to damage the image bearing members. Because the transfuse member can be maintained at a higher temperature, the transfuse member can be relatively thick. A thick transfuse member is a multiple layer transfer member having a back layer and an over layer. The over layer can be a single layer or intermediate layers with a top most layer. The over layer is preferably greater than 0.25 mm, and more preferably greater than 1.0 mm.

Thick transfuse members are generally preferred over thin members for a number of reasons. For example release of melted toner and stripping of a copy sheet from a toner fixing surface can be significantly helped by employing shear stresses in the fixing surface in the high pressure third transfer nip that are generally referred to as "creep". The desired optimum creep for self stripping of a document and for good operating latitude for toner release generally requires a rubber over layer in the range of 0.5 mm to greater than 1 mm. A thick rubber over layer is also desired for creating a high degree of conformance to enable good transfer and fix in the third transfer nip when rough papers are used. A thick transfuse belt thus generally has more media latitude than a thin transfuse belt. Thick transfuse members are also desired over thin members for achieving higher operational life. Finally, thick over layers are highly advantaged for transfuse systems that may wish to achieve low gloss in the third transfer nip and employ an optional post transfuse gloss enhancing system to allow operators to optionally choose high or low gloss print output.

DETAILED DESCRIPTION OF THE PREFERRED EMBODIMENTS

Figure 1:
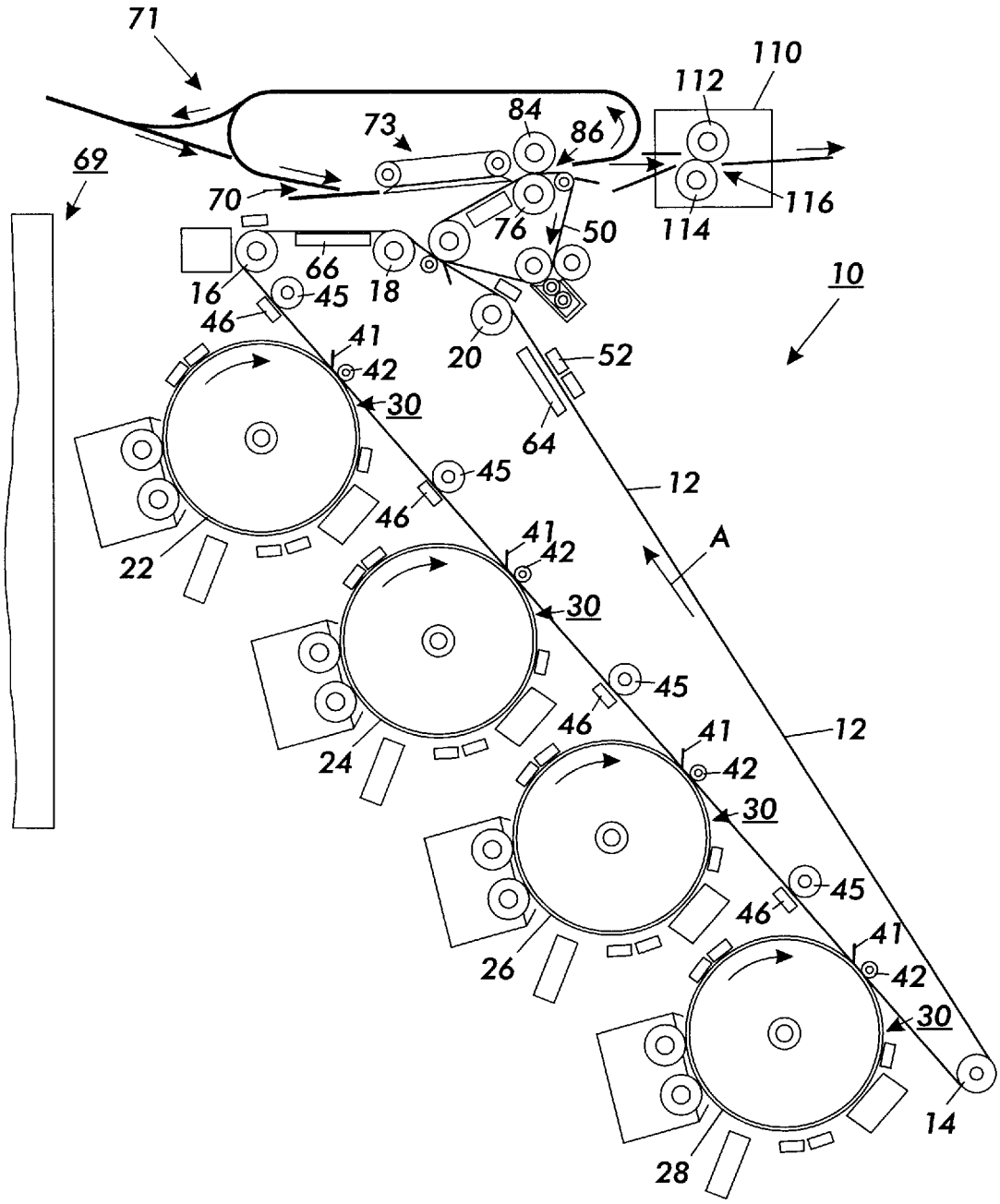
FIG. 1 is a schematic side view of a duplex cut sheet electrostatographic printer in accordance with the invention.
Figure 2:
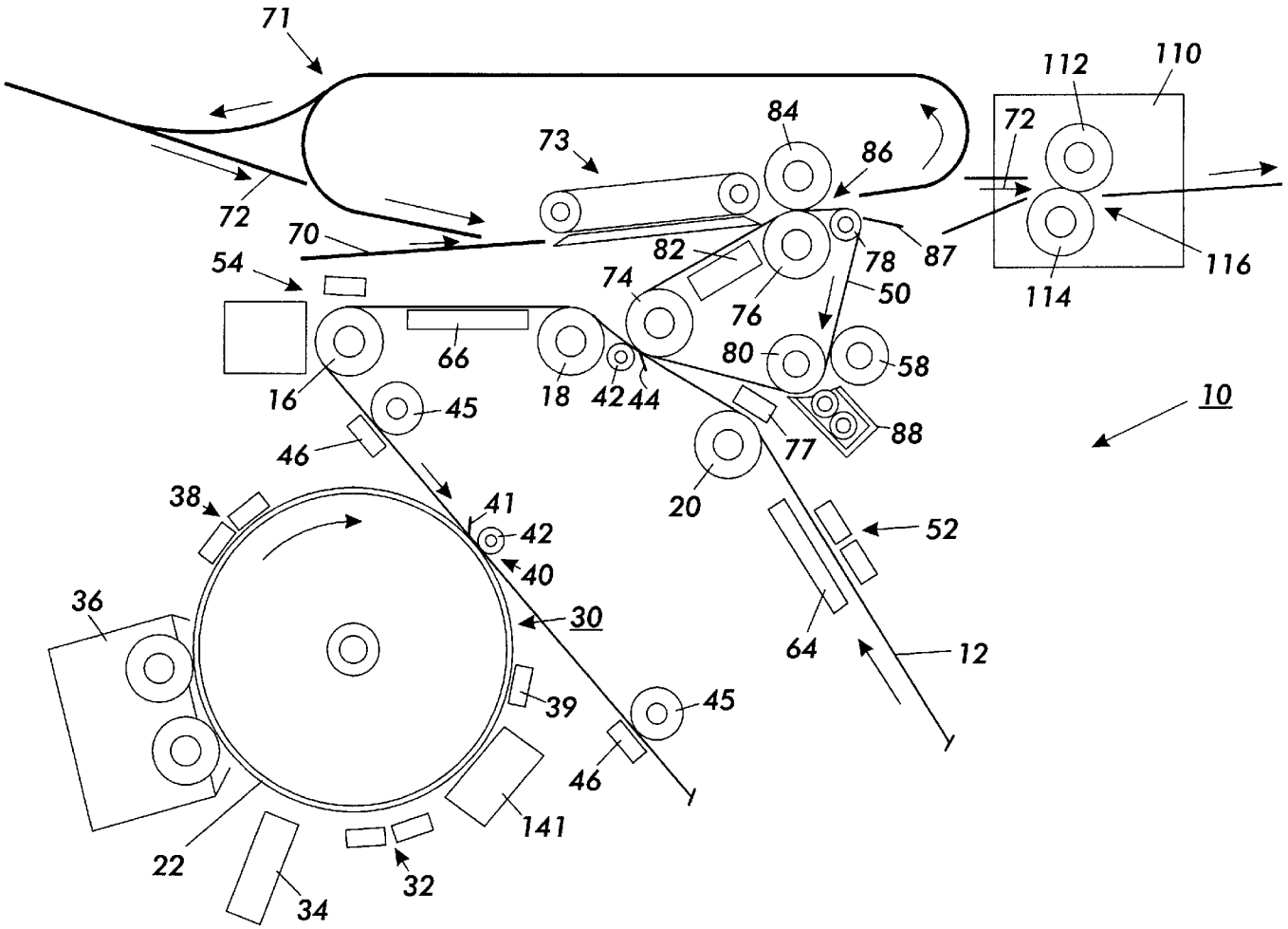
FIG. 2 is an enlarged schematic side view of the transfer nips of the printer of FIG. 1.

With reference to FIGS. 1 and 2, a multi-color cut sheet duplex electrostatographic printer 10 has an intermediate transfer belt 12. The intermediate transfer belt 12 is driven over guide rollers 14, 16, 18, and 20. The intermediate transfer belt 12 moves in a process direction shown by the arrow A. For purposes of discussion, the intermediate transfer member 12 defines a single section of the intermediate transfer member 12 as a toner area. A toner area is that part of the intermediate transfer member which receives the various processes by the stations positioned around the intermediate transfer member 12. The intermediate transfer member 12 may have multiple toner areas; however, each toner area is processed in the same way.

The toner area is moved past a set of four toner image producing stations 22, 24, 26, and 28. Each toner image producing station 22, 24, 26, 28 operates to place a color toner image on the toner image of the intermediate transfer member 12. Each toner image producing station 22, 24, 26, 28 operates in the same manner to form developed toner image for transfer to the intermediate transfer member 12. The image producing stations 22, 24, 26, 28 are described in terms of a photoreceptive system, but it is readily recognized by those of skilled in the art that ionographic systems and other marking systems can readily be employed to form developed toner images. Each toner image producing station 22, 24, 26, 28 has an image bearing member 30. The image bearing member 30 is a drum or belt supporting a photoreceptor.

The image bearing member 30 is uniformly charged at a charging station 32. The charging station is of well-known construction, having charge generation devices such as corotrons or scorotrons for distribution of an even charge on the surface of the image bearing member 30. An exposure station 34 exposes the charged image bearing member 30 in an image-wise fashion to form an electrostatic latent image at the image area. For purposes of discussion, the image bearing member defines an image area. The image area is that part of the image bearing member which receives the various processes by the stations positioned around the image bearing member 30. The image bearing member 30 may have multiple image areas; however, each image area is processed in the same way.

The exposure station 34 preferably has a laser emitting a modulated laser beam. The exposure station 34 raster scans the modulated laser beam onto the charged image area. The exposure station 34 can alternately employ LED arrays or other arrangements known in the art to generate a light image representation that is projected onto the image area of the image bearing member 30. The exposure station 34 exposes a light image representation of one color component of a composite color image onto the image area to form a first electrostatic latent image. Each of the toner image producing stations 22, 24, 26, 28 will form an electrostatic latent image corresponding to a particular color component of a composite color image.

The image area is advanced to a development station 36. The developer station 36 has a developer corresponding to the color component of the composite color image. Typically, therefore, individual toner image producing stations 22, 24, 26, and 28 will individually develop the cyan, magenta, yellow, and black that make up a typical composite color image. Additional toner image producing stations can be provided for additional or alternate colors including highlight colors or other custom colors. Therefore, each of the toner image producing stations 22, 24, 26, 28 develops a component toner image for transfer to the toner area of the intermediate transfer member 12. The developer station 36 preferably develops the latent image with a charged dry toner powder to form the developed component toner image. The developer can employ a magnetic toner brush or other well-known development arrangements.

The image area having the component toner image then advances to the pretransfer station 38. The pretransfer station 38 preferably has a pretransfer charging device to charge the component toner image and to achieve some leveling of the surface voltage above the image bearing member 30 to improve transfer of the component image from the image bearing member 30 to the intermediate transfer member 12. Alternatively the pretransfer station 38 can use a pretransfer light to level the surface voltage above the image bearing member 30. Furthermore, this can be used in cooperation with a pretransfer charging device. The image area then advances to a first transfer nip defined between the image bearing member 30 and the intermediate transfer member 12. The image bearing member 30 and intermediate transfer member 12 are synchronized such that each has substantially the same linear velocity at the first transfer nip 40. The component toner image is electrostatically transferred from the image bearing member 30 to the intermediate transfer member 12 by use of a field generation station 42. The field generation station 42 is preferably a bias roller that is electrically biased to create sufficient electrostatic fields of a polarity opposite that of the component toner image to thereby transfer the component toner image to the intermediate transfer member 12. Alternatively the field generation station 42 can be a corona device or other various types of field generation systems known in the art. A prenip transfer blade 44 mechanically biases the intermediate transfer member 12 against the image bearing member 30 for improved transfer of the component toner image. The toner area of the intermediate transfer member 12 having the component toner image from the toner image producing station 22 then advances in the process direction.

After transfer of the component toner image, the image bearing member 30 then continues to move the image area past a preclean station 39. The preclean station employs a pre clean corotron to condition the toner charge and the charge of the image bearing member 30 to enable improved cleaning of the image area. The image area then further advances to a cleaning station 141. The cleaning station 41 removes the residual toner or debris from the image area. The cleaning station 141 preferably has blades to wipe the residual toner particles from the image area. Alternately the cleaning station 141 can employ an electrostatic brush cleaner or other well knows cleaning systems. The operation of the cleaning station 141 completes the toner image production for each of the toner image producing stations 22, 24, 26, and 28.

The first component toner image is advanced at the image area from the first transfer nip 40 of the image producing station 22 to the first transfer nip 40 of the toner image producing station 24. Prior to entrance of the first transfer nip 40 of the toner image producing station 24 an image conditioning station 46 uniformly charges the component toner image to reduce stray, low or oppositely charged toner that would result in back transfer of some of the first component toner image to the subsequent toner image producing station 24. The image conditioning stations, in particular the image conditioning station prior to the first toner image producing station 22 also conditions the surface charge on the intermediate transfer member 12. At each first transfer nip 40, the subsequent component toner image is registered to the prior component toner images to form a composite toner image after transfer of the final toner image by the toner image producing station 28.

The geometry of the interface of the intermediate transfer member 12 with the image bearing member 30 has an important role in assuring good transfer of the component toner image. The intermediate transfer member 12 should contact the surface of the image bearing member 30 prior to the region of electrostatic field generation by the field generation station 42, preferably with some amount of pressure to insure intimate contact. Generally, some amount of pre-nip wrap of the intermediate transfer member 12 against the image bearing member 30 is preferred. Alternatively, the pre-nip pressure blade 44 or other mechanical biasing structure can be provided to create such intimate pre-nip contact. This contact is an important factor in reducing high electrostatic fields from forming at air gaps between the intermediate transfer member 12 and the component toner image in the pre-nip region. For example, with a corotron as the field generation station 42, the intermediate transfer member 12 should preferably contact the toner image in the pre-nip region sufficiently prior to the start of the corona beam profile. With a field generation station 42 of a bias charging roller, the intermediate transfer member 12 should preferably contact the toner image in the pre-nip region sufficiently prior to the contact nip of the bias charging roller. "Sufficiently prior" for any field generation device can be taken to mean prior to the region of the pre-nip where the field in any air gap greater than about $50\mu$ between the intermediate transfer member 12 and the component toner image has dropped below about 4 volts/micron due to falloff of the field with pre-nip distance from the first transfer nip 40. The falloff of the field is partly due to capacitance effects and this will depend on various factors. For example, with a bias roller this falloff with distance will be slowest with larger diameter bias rollers, and/or with higher resistivity bias rollers, and/or if the capacitance per area of the insulating layers in the first transfer nip 40 is lowest. Lateral conduction along the intermediate transfer member 12 can even further extend the transfer field region in the pre-nip, depending on the transfer belt resistivity and other physical factors. Using intermediate transfer members 12 having resistivity nearer the lower end of the preferred range discussed below and/or systems that use large bias rollers, etc., preference is larger pre-nip contact distances. Generally the desired pre-nip contact is between about 2 to 10 mm for resistivities within the desired range and with bias roller diameters between about 12 mm and 50 mm.

The field generation station 42 will preferentially use very conformable bias rollers for the first transfer nips 40 such as foam or other roller materials having an effectively very low durometer ideally less than about 30 Shore A. In systems that use belts for the imaging modules, optionally the first transfer nip 40 can include acoustic loosening of the component toner image to assist transfer.

In the preferred arrangement, "slip transfer" is employed for registration of the color image. For slip transfer, the contact zone between the intermediate transfer member 12 and the image bearing member 30 will preferably be minimized subject to the pre-nip restrictions. The post transfer contact zone past the field generation station 42 is preferentially small for this arrangement. Generally, the intermediate transfer member 12 can optionally separate along the preferred bias roller of the field generation station 42 in the post nip region if an appropriate structure is provided to insure that the bias roller does not lift off the surface of the image bearing member due to the tension forces of the intermediate transfer member 12. For slip transfer systems, the pressure of the bias roller employed in the field generation station 42 should be minimized. Minimized contact zone and pressure minimizes the frictional force acting on the image bearing member 30 and this minimizes elastic stretch issues of the intermediate transfer member 12 between first transfer nips 40 that can degrade color registration. It will also minimize motion interactions between the drive of the intermediate transfer member 12 and the drive of the image bearing member 30.

For slip transfer systems, the resistivity of the intermediate transfer member 12 should also be chosen to be high, generally within or even toward the middle to upper limits of the most preferred range discussed later, so that the required pre-nip contact distances can be minimized. In addition, the coefficient of friction of the top surface material on the intermediate transfer member should preferentially be minimized to increase operating latitude for the slip transfer registration and motion quality approach.

In an alternate embodiment the image bearing members 30, such as photoconductor drums, do not have separate drives and instead are driven by the friction in the first transfer nips 40. In other words, the image bearing members 30 are driven by the intermediate transfer member 12. Therefore, the first transfer nip 40 imparts sufficient frictional force on the image bearing member to overcome any drag created by the development station 36, cleaner station 41, additional subsystems and by bearing loads. For a friction driven image bearing member 30, the optimum transfer design considerations are generally opposite to the slip transfer case. For example, the lead in of the intermediate transfer member 12 to the first transfer zone preferentially can be large to maximize the friction force due to the tension of the intermediate transfer member 12. In the post transfer zone, the intermediate transfer member 12 is wrapped along the image bearing member 30 to further increase the contact zone and to therefore increase the frictional drive. Increased post-nip wrap has a larger benefit than increased pre-nip wrap because there will be increased pressure there due to electrostatic tacking forces. As another example, the pressure applied by the field generation device 42 can further increase the frictional force. Finally for such systems, the coefficient of friction of the material of the top most layer on the intermediate transfer member 12 should preferentially be higher to increase operating latitude.

The toner area then is moved to the subsequent first transfer nip 40. Between toner image producing stations are the image conditioning stations 46. The charge transfer in the first transfer nip 40 is normally at least partly due to air breakdown, and this can result in non uniform charge patterns on the intermediate transfer member 12 between the toner image producing stations 22, 24, 26, 28. As discussed later, the intermediate transfer member 12 can optionally include insulating topmost layers, and in this case non uniform charge will result in non uniform applied fields in the subsequent first transfer nips 40. The effect accumulates as the intermediate transfer member 12 proceeds through the subsequent first transfer nips 40. The image conditioning stations 46 "level" the charge patterns on the belt between the toner image producing stations 22, 24, 26, 28 to improve the uniformity of the charge patterns on the intermediate transfer member 12 prior to subsequent first transfer nips 40. The image conditioning stations 46 are preferably scorotrons and alternatively can be various types of corona devices. As previously discussed, the charge conditioning stations 46 additionally are employed for conditioning the toner charge to prevent re-transfer of the toner to the subsequent toner image producing stations. The need for image conditioning stations 46 is reduced if the intermediate transfer member 12 consists only of semiconductive layers that are within the desired resistivity range discussed later. As further discussed later, even if the intermediate transfer member 12 includes insulating layers, the need for image conditioning stations 46 between the toner image producing stations 22, 24, 26, 28 is reduced if such insulating layers are sufficiently thin.

The guide roller 14 is preferably adjustable for tensioning the intermediate transfer member 12. Additionally, the guide roller 14 can, in combination with a sensor sensing the edge of the intermediate transfer member 12, provide active steering of the intermediate transfer member 12 to reduce transverse wander of the intermediate transfer member 12 that would degrade registration of the component toner images to form the composite toner image.

Each toner image producing station positions component toner image on the toner area of the intermediate transfer member 12 to form a completed composite toner image. The intermediate transfer member 12 transports the composite toner image from the last toner image producing station 28 to pre-transfer charge conditioning station 52. When the intermediate transfer member 12 includes at least one insulating layer, the pretransfer charge conditioning station 52 levels the charge at the toner area of the intermediate transfer member 12. In addition the pre-transfer charge conditioning station 52 is employed to condition the toner charge for transfer to a transfuse member 50. It preferably is a scorotron and alternatively can be various types of corona devices. A second transfer nip 48 is defined between the intermediate transfer member 12 and the transfuse member 50. A field generation station 42 and pre-transfer nip blade 44 engage the intermediate transfer member 12 adjacent the second transfer nip 48 and perform the same functions as the field generation stations and pre-transfer blades 44 adjacent the first transfer nips 40. However the field generation station at the second transfer nip 48 can be relatively harder to engage conformable transfuse members 50. The composite toner image is transferred electrostatically and with heat assist to the transfuse member 50.

The electrical, characteristics of the intermediate transfer member 12 are also important. The intermediate transfer member 12 can optionally be constructed of a single layer or multiple layers. In any case, preferably the electrical properties of the intermediate transfer member 12 are selected to reduce high voltage drops across the intermediate transfer member. To reduce high voltage drops, the resistivity of the back layer of the intermediate transfer member 12 preferably has sufficiently low resistivity. The electrical characteristics and the transfer geometry must also be chosen to prevent high electrostatic transfer fields in pre-nip regions of the first and second transfer nips 40, 48. High pre-nip fields at air gaps of around typically >50 microns between the component toner images and the intermediate transfer member 12 can lead to image distortion due to toner transfer across an air gap and can also lead to image defects caused by pre-nip air breakdown. This can be avoided by bringing the intermediate transfer member 12 into early contact with the component toner image prior to the field generating station 42, as long as the resistivity of any of the layers of the intermediate transfer member 12 are sufficiently high. The intermediate transfer member 12 also should have sufficiently high resistivity for the topmost layer to prevent very high current flow from occurring in the first and second transfer nips 40, 48. Finally, the intermediate transfer member 12 and the system design needs to minimize the effect of high and/or non-uniform charge buildup that can occur on the intermediate transfer member 12 between the first transfer nips 40.

The preferable material for a single layer intermediate transfer member 12 is a semiconductive material having a "charge relaxation time" that is comparable to or less than the dwell time between toner image producing stations, and more preferred is a material having a "nip relaxation time" comparable or less than the transfer nip dwell time. As used here, "relaxation time" is the characteristic time for the voltage drop across the thickness of the layer of the intermediate transfer member to decay. The dwell time is the time that an elemental section of the transfer member 12 spends moving through a given region. For example, the dwell time between imaging stations 22 and 24 is the distance between imaging stations 22 and 24, divided by the process speed of the transfer member 12. The transfer nip dwell time is the width of the contact nip created during the influence of the field generation station 42, divided by the process speed of the transfer member 12.

The "charge relaxation time" is the relaxation time when the intermediate transfer member is substantially isolated from the influence of the capacitance of other members within the transfer nips 40. Generally the charge relaxation time applies for regions prior to or past the transfer nips 40. It is the classic "RC time constant", that is $\rho\kappa\epsilon_0$, the product of the material layer quantities dielectric constant KL times resistivity $\rho L$ times the permitivity of vacuum $\epsilon_0$. In general the resistivity of a material can be sensitive to the applied field in the material. In this case, the resistivity should be determined at an applied field corresponding to about 25 to 100 volts across the layer thickness. The "nip relaxation time" is the relaxation time within regions such as the transfer nips 40. If 42 is a corona field generation device, the "nip relaxation time" is substantially the same as the charge relaxation time. However, if a bias transfer device is used, the nip relaxation time is generally longer than the charge relaxation time. This is because it is influenced not only by the capacitance of the intermediate transfer member 12 itself, but it is also influenced by the extra capacitance per unit area of any insulating layers that are present within the transfer nips 40. For example, the capacitance per unit area of the photoconductor coating on the image bearing member 30 and the capacitance per unit area of the toner image influence the nip relaxation time. For discussion, $C_L$ represents the capacitance per unit area of the layer of the intermediate transfer member 12 and $C_{tot}$ represents the total capacitance per unit area of all insulating layers in the first transfer nips 40, other than the intermediate transfer member 12. When the field generation station 42 is a bias roller, the nip relaxation time is the charge relaxation time multiplied by the quantity $[1+(C_{tot}/C_L)]$.

The range of resistivity conditions defined in the above discussion avoid high voltage drops across the intermediate transfer member 12 during the transfers of the component toner images at the first transfer nips 40. To avoid high pre-nip fields, the volume resistivity in the lateral or process direction of the intermediate transfer member must not be too low. The requirement is that the lateral relaxation time for charge flow between the field generation station 42 in the first transfer nip 40 should be larger than the lead in dwell time for the first transfer nip 40. The lead in dwell time is the quantity L/v. L is the distance from the pre-nip region of initial contact of the intermediate transfer member 12 with the component toner image, to the position of the start of the field generation station 42 within the first transfer nip 40. The quantity v is the process speed. The lateral relaxation time is proportional to the lateral resistance along the belt between the field generating station 42 and the pre-nip region of initial contact, and the total capacitance per area $C_{tot}$ of the insulating layers in the first transfer nip 40 between the intermediate transfer member 12 and the substrate of the image bearing member 30 of the toner image producing station 22, 24, 26, 28. A useful expression for estimating the preferred resistivity range that avoids undesirable high pre-nip fields near the field generation stations 42 is: $[\rho_L\ VLC_{tot}]>1$. The quantity is referred to as the "lateral resistivity" of the intermediate transfer member 12. It is the volume resistivity of the member divided by the thickness of the member. In cases where the electrical properties of the member 12 is not isotropic, the volume resistivity of interest for avoiding high pre-nip fields is that resistivity of the layer in the process direction. Also, in cases where the resistivity depends on the applied field, the lateral resistivity should be determined at a field of between about 500 to 1500 volts/cm.

Thus the preferred range of resistivity for the single layer intermediate transfer member 12 depends on many factors such as for example the system geometry, the transfer member thickness, the process speed, and the capacitance per unit area of the various materials in the first transfer nip 40. For a wide range of typical system geometry and process speeds the preferred resistivity for a single layer transfer belt is typically a volume resistivity less than about $10^{13}$ ohm-cm and a more preferred range is typically $<10^{11}$ ohm-cm volume resistivity. The lower limit of preferred resistivity is typically a lateral resistivity above about $10^8$ ohms/square and more preferred is typically a lateral resistivity above about $10^{10}$ ohms/square. As an example, with a typical intermediate transfer member 12 thickness of around 0.01 cm, a lateral resistivity greater than $10^{10}$ ohms/square corresponds to a volume resistivity of greater than $10^8$ ohm-cm.

Discussion below will specify the preferred range of electrical properties for the transfuse member 50 to allow good transfer in the second transfer nip 48. The transfuse member 50 will preferably have multiple layers and the electrical properties chosen for the topmost layer of the transfuse member 50 will influence the preferred resistivity for the single layer intermediate transfer member 12. The lower limits for the preferred resistivity of the single layer intermediate transfer member 12 referred to above apply if the top most surface layer of the transfuse member 50 has a sufficiently high resistivity, typically equal to or above about 109 ohm-cm. If the top most surface layer of the transfuse member 50 has a somewhat lower resistivity than about $10^9$ ohm-cm, the lower limit for the preferred resistivity of the single layer intermediate transfer member 12 should be increased in order to avoid transfer problems in the second transfer nip 48. Such problems include undesirably high current flow between the intermediate transfer member 12 and the transfuse member 50, and transfer degradation due to reduction of the transfer field. In the case where the resistivity of the top most layer of the transfuse member 50 is less than about $10^9$ ohm-cm, the preferred lower limit volume resistivity for the single layer intermediate transfer member 12 will typically be around greater than or equal to $10^9$ ohm-cm.

In addition, the intermediate transfer member 12 should have sufficient lateral stiffness to avoid registration issues between toner image producing stations 22, 24, 26, 28 due to elastic stretch. Stiffness is the sum of the products of Young's modulus times the layer thickness for all of the layers of the intermediate transfer member. The preferred range for the stiffness depends on various systems parameters. The required value of the stiffness increases with increasing amount of frictional drag at and/or between the toner image producing stations 22, 24, 26, 28. The preferred stiffness also increases with increasing length of the intermediate transfer member 12 between toner image producing stations, and with increasing color registration requirements. The stiffness is preferably >800 PSI-inches and more preferably >2000 PSI-inches.

A preferred material for the single layer intermediate transfer member 12 is a polyamide that achieves good electrical control via conductivity controlling additives.

The intermediate transfer member 12 may also optionally be multi-layered. The back layer, opposite the toner area, will preferably be semi-conductive in the discussed range. The preferred materials for the back layer of a multi-layered intermediate transfer member 12 are the same as that discussed for the single layer intermediate belt 12. Within limits, the top layers can optionally be "insulating" or semiconductive. There are certain advantages and disadvantages of either.

A layer on the intermediate transfer member 12 can be thought of as behaving "insulating" for the purposes of discussion here if the relaxation time for charge flow is much longer than the dwell time of interest. For example, a layer behaves "insulating" during the dwell time in the first transfer nip 40 if the nip relaxation time of that layer in the first transfer nip 40 is much longer than the time that a section of the layer spends in traveling through the first transfer nip 40. A layer behaves insulating between toner image producing stations 22, 24, 26, 28 if the charge relaxation time for that layer is much longer than the dwell time that a section of the layer takes to travel between the toner image producing stations. On the other hand, a layer behaves semiconducting in the sense meant here when the relaxation times are comparable or lower than the appropriate dwell times. For example, a layer behaves semi conductive during the dwell time of the first transfer nip 40 when the nip relaxation time is less than the dwell time in the first transfer nip 40. Furthermore, a layer on the intermediate transfer member 12 behaves semiconductive during the dwell time between toner image producing stations 22, 24, 26, 28 if the relaxation time of the layer is less than the dwell time between toner image producing stations. The expressions for determining the relaxation times of any top layer on the intermediate transfer member 12 are substantially the same as those described previously for the single layer intermediate transfer member. Thus whether or not a layer on the multi-layered intermediate transfer member 12 behaves "insulating" or "semiconducting" during a particular dwell time of interest depends not only on the electrical properties of the layer but also on the process speed, the system geometry, and the layer thickness.

A layer of the transfer belt will typically behave "insulating" in most transfer systems if the volume resistivity is generally greater than about $10^{13}$ ohm-cm. Insulating top layers on the intermediate transfer member 12 cause a voltage drop across the layer and thus reduce the voltage drop across the composite toner layer in the first transfer nip 40. Therefore, the presence of insulating layers requires higher applied voltages in the first and second transfer nips 40, 48 to create the same electrostatic fields operating on the charged composite toner image. The voltage requirement is mainly driven by the "dielectric thickness" of such insulating layers, which is the actual thickness of a layer divided by the dielectric constant of that layer. One potential disadvantage of an insulating layer is that undesirably very high voltages will be required on the intermediate transfer member 12 for good electrostatic transfer of the component toner image if the sum of the dielectric thickness of the insulating layers on the intermediate transfer member 12 is too high. This is especially true in color imaging systems with layers that behave "insulating" over the dwell time longer than one revolution of the intermediate transfer member 12. Charge will build up on such insulating top layers due to charge transfer in each of the field generation stations 42. This charge buildup requires higher voltage on the back of the intermediate transfer member 12 in the subsequent field generation stations 42 to achieve good transfer of the subsequent component toner images. This charge can not be fully neutralized between first transfer nips 40 with image conditioning station 46 corona devices without also causing undesirable neutralization or even reversal of the charge of the transferred composite toner image on the intermediate transfer member 12. Therefore, to avoid the need for unacceptably high voltages on the back of the intermediate transfer member 12, the total dielectric thickness of such insulating top layers on the intermediate transfer member 12 should preferably be kept small for good and stable transfer performance. An acceptable total dielectric thickness can be as high as about 50 $\mu$m and a preferred value is <10 $\mu$m.

The top most layer of the intermediate transfer member 12 preferably has good toner releasing properties such as low surface energy, and preferably has low affinity to oils such as silicone oils. Materials such as PFA, TEFLON™, and various flouropolymers are examples of desirable overcoating materials having good toner release properties. One advantage of an insulating coating over the semiconductive backing layer of the intermediate transfer member 12 is that such materials with good toner releasing properties are more readily available if the constraint of needing them to also be semiconductive is removed. Another potential advantage of high resistivity coatings applies to embodiments that wish to use a transfuse member 50 having a low resistivity top most layer, such as $<<10^9$ ohm-cm. As discussed, the resistivity for the intermediate transfer member 12 of a single layer is preferably limited to typically around $>10^9$ ohm-cm to avoid transfer problems in the second transfer nip 48 if the resistivity of the top most layer of the transfuse member 50 is lower than about $10^9$ ohm-cm. For a multiple layer intermediate transfer member 12, having a sufficiently high resistivity top most layer, preferably $>10^9$ ohm-cm, the resistivity of the back layer can be lower.

Semiconductive coatings on the intermediate transfer member 12 are advantaged in that they do not require charge leveling to level the charge on the intermediate transfer member 12 prior to and between toner image producing stations 22, 24, 26, 28. Semiconductive coatings on the intermediate transfer member are also advantaged in that much thicker top layers can be allowed compared to insulating coatings. The charge relaxation conditions and the corresponding ranges of resistivity conditions needed to enable such advantages are similar to that already discussed for the back layer. Generally, the semiconductive regime of interest is a resistivity such that the charge relaxation time is smaller than the dwell time spent between toner image producing stations 22, 24, 26, 28. A more preferred resistivity construction allows thick layers, and this construction is a resistivity range such that the nip relaxation time within the first transfer nip 40 is smaller than the dwell time that a section of the intermediate transfer member 12 takes to move through the first transfer nip 40. In such a preferred regime of resistivity the voltage drop across the layer is small at the end of the transfer nip dwell time, due to charge conduction through the layer.

The constraint on the lower limit of the resistivity related to the lateral resistivity apply to the semiconductive top most layer, to any semiconductive middle layers, and to the semiconductive back layer of a multiple layer intermediate transfer member 12. The preferred resistivity range for each such layer is substantially the same as discussed for the single layer intermediate transfer member 12. Also, the additional constraint on the resistivity related to transfer problems in the second transfer nip 48 apply to the top most layer of a multiple layer intermediate transfer member 12. Preferably, the top most semiconductive layer of the intermediate transfer member 12 should be typically $>10^9$ ohm-cm when the top most layer of the transfuse member 50 is typically somewhat less than $10^9$ ohm-cm.

Transfer of the composite toner image in the second transfer nip 48 is accomplished by a combination of electrostatic and heat assisted transfer. The field generation station 42 and guide roller 74 are electrically biased to electrostaticly transfer the charged composite toner image from the intermediate transfer member 12 to the transfuse member 50.

The transfer of the composite toner image at the second transfer nip 48 can be heat assisted if the temperature of the transfuse member 50 is maintained at a sufficiently high optimized level and the temperature of the intermediate transfer member 12 is maintained at a considerably lower optimized level prior to the second transfer nip 48. The mechanism for heat assisted transfer is thought to be softening of the composite toner image during the dwell time of contact of the toner in the second transfer nip 48. The toner softening occurs due to contact with the higher temperature transfuse member 50. This composite toner softening results in increased adhesion of the composite toner image toward the transfuse member 50 at the interface between the composite toner image and the transfuse member. This also results in increased cohesion of the layered toner pile of the composite toner image. The temperature on the intermediate transfer member 12 prior to the second transfer nip 48 needs to be sufficiently low to avoid too high a toner softening and too high a resultant adhesion of the toner to the intermediate transfer member 12. The temperature of the transfuse member 50 should be considerably higher than the toner softening point prior to the second transfer nip to insure optimum heat assist in the second transfer nip 48. Further, the temperature of the intermediate transfer member 12 just prior to the second transfer nip 48 should be considerably lower than the temperature of the transfuse member 50 for optimum transfer in the second transfer nip 48.

The temperature of the intermediate transfer member 12 prior to the second transfer nip 48 is important for maintaining good transfer of the composite toner image. An optimum elevated temperature for the intermediate transfer member 12 can allow the desired softening of the composite toner image needed to permit heat assist to the electrostatic transfer of the second transfer nip 48 at lower temperatures on the transfuse member 50. However, there is a risk of the temperature of the intermediate transfer member 12 becoming too high so that too much softening of the composite toner image occurs on the intermediate transfer member prior to the second transfer nip 48. This situation can cause unacceptably high adhesion of the composite toner image to the intermediate transfer member 12 with resultant degraded second transfer. Preferably the temperature of the intermediate transfer member 12 is maintained below or in the range of the TG (glass transition temperature) of the toner prior to the second transfer nip 48.

The transfuse member 50 is guided in a cyclical path by guide rollers 74, 76, 78, 80. Guide rollers 74, 76 alone or together are preferably heated to thereby heat the transfuse member 50. The intermediate transfer member 12 and transfuse member 50 are preferably synchronized to have the generally same velocity in the transfer nip 48. Additional heating of the transfuse member is provided by a heating station 82. The heating station 82 is preferably formed of infra-red lamps positioned internally to the path defined by the transfuse member 50. Alternatively the heating station 82 can be a heated shoe contacting the back of the transfuse member 50 or other heat sources located internally or externally to the transfuse member 50. The transfuse member 50 and a pressure roller 84 define a third transfer nip 86 therebetween.

A releasing agent applicator 88 applies a controlled quantity of a releasing material, such as a silicone oil to the surface of the transfuse member 50. The releasing agent serves to assist in release of the composite toner image from the transfuse member 50 in the third transfer nip 86.

The transfuse member 50 is preferably constructed of multiple layers. The transfuse member 50 must have appropriate electrical properties for being able to generate high electrostatic fields in the second transfer nip 50. To avoid the need for unacceptably high voltages, the transfuse member 50 preferably has electrical properties that enable sufficiently low voltage drop across the transfuse member 50 in the second transfer nip 48. In addition the transfuse member 50 will preferably ensure acceptably low current flow between the intermediate transfer member 12 and the transfuse member 50. The requirements for the transfuse member 50 depend on the chosen properties of the intermediate transfer member 12. In other words, the transfuse member 50 and intermediate transfer member 12 together have sufficiently high resistance in the second transfer nip 48.

The transfuse member 50 will preferably have a laterally stiff back layer, a thick, conformable rubber intermediate layer, and a thin outer most layer. Preferably the thickness of the back layer will be greater than about 0.05 mm. Preferably the thickness of the intermediate conformable layers and the top most layer together will be greater than 0.25 mm and more preferably will be greater than about 1.0 mm. The back and intermediate layers need to have sufficiently low resistivity to prevent the need for unacceptably high voltage requirements in the second transfer zone 48. The preferred resistivity condition follows previous discussions given for the intermediate transfer member 12. That is, the preferred resistivity range for the back and intermediate layer of a multiple layer transfuse member 50 insures that the nip relaxation time for these layers in the field generation region of the second transfer nip 48 is smaller than the dwell time spent in the field generation region of the second transfer nip 48. The expressions for the nip relaxation times and the nip dwell time are substantially the same as the ones discussed for the single layer intermediate transfer member 12. Thus the specific preferred resistivity range for the back and intermediate layers depends on the system geometry, the layer thickness, the process speed, and the capacitance per unit area of the insulating layers within the transfer nip 48. Generally, the volume resistivity of the back and intermediate layers of the multi-layer transfuse member 50 will typically need to be below about $10^{11}$ ohm-cm and more preferably will be below about $10^{8}$ ohm-cm for most systems. Optionally, the back layer of the transfuse member 50 can be highly conductive such as a metal.

Similar to the multiple layer intermediate transfer member 12, the top most layer of the transfuse member 50 can optionally behave "insulating" during the dwell time in the transfer nip 48 (typically $>10^{12}$ ohm-cm) or semiconducting during the transfer nip 48 (typically $10^{6}$ and $10^{12}$ ohm-cm). However, if the top most layer behaves insulating, the dielectric thickness of such a layer will preferably be sufficiently low to avoid the need for unacceptably high voltages. Preferably for such insulating behaving top most layers, the dielectric thickness of the insulating layer should typically be less than about $50\mu$ and more preferably will be less than about $10\mu$. If a very high resistivity insulating top most layer is used, such that the charge relaxation time is greater than the transfuse member cycle time, charge will build up on the transfuse member 50 due to charge transfer during the transfer nip 48. Therefore, a cyclic discharging station 77 such as a scorotron or other charge generating device will be needed to control the uniformity and reduce the level of cyclic charge buildup.

The transfuse member 50 can alternatively have additional intermediate layers. Any such additional intermediate layers that have a high dielectric thickness typically greater than about 10 microns will preferably have a sufficiently low resistivity such to ensure low voltage drop across the additional intermediate layers.

The transfuse member 50 preferably has a top most layer formed of a material having a low surface energy, for example silicone elastomer, fluoroelastomers such as Viton™, polytetrafluoroethylene, perfluoralkane, and other fluorinated polymers. The transfuse member 50 will preferably have intermediate layers between the top most and back layers constructed of a Viton™ or silicone with carbon or other conductivity enhancing additives to achieve the desired electrical properties. The back layer is preferably a fabric modified to have the desired electrical properties. Alternatively the back layer can be a metal such as stainless steel.

The transfuse member 50 can optionally be in the form of a transfuse roller (not shown), or is preferably in the form of a transfuse belt. A transfuse roller for the transfuse member 50 can be more compact than a transfuse belt and it can also be advantaged relative to less complexity of the drive and steering requirements needed to achieve good motion quality for color systems. However, a transfuse belt has advantages over a transfuse roller such as enabling large circumference for longer life, better substrate stripping capability, and generally lower replacement costs.

The intermediate layer of the transfuse member 50 is preferably thick to enable a high degree of conformance to rougher substrates 70 and to thus expand the range of substrate latitude allowed for use in the printer 10. In addition the use of a relatively thick intermediate layer, greater than about 0.25 mm and preferably greater than 1.0 mm enables creep for improved stripping of the document from the output of the third transfer nip 86. In a further embodiment, thick low durometer conformable intermediate and top most layers such as silicone are employed on the transfuse member 50 to enable creation of low image gloss by the transfuse system with wide operating latitude.

The use of a relatively high temperature on the transfuse member 50 prior to the second transfer nip 48 creates advantages for the transfuse system. The transfer step in the second transfer nip 48 simultaneously transfers single and stacked multiple color toner layers of the composite toner image. The toner layers nearest to the transfer belt interface will be hardest to transfer. A given separation color toner layer can be nearest the surface of the intermediate transfer member 12 or it can also be separated from the surface, depending on the color toner layer to be transferred in any particular region. For example, if a toner layer of magenta is the last stacked layer deposited onto the transfer belt, the magenta layer can be directly against the surface of the intermediate transfer member 12 in some color print regions or else stacked above cyan and/or yellow toner layers in other color regions. If transfer efficiency is too low, a high fraction of the color toners that are close to the intermediate transfer member 12 will not transfer but a high fraction of the same color toner layers that are stacked onto another color toner layer will transfer. Thus for example, if the transfer efficiency of the composite toner image is not very high, the region of the composite toner image having cyan toner directly in contact with the surface of the intermediate transfer member 12 can transfer less of the cyan toner layer than the regions of the composite toner image having cyan toner layers on top of yellow toner layers. The transfer efficiency in the second transfer nip 48 is >95% therefore avoiding significant color shift.

Figure 9:
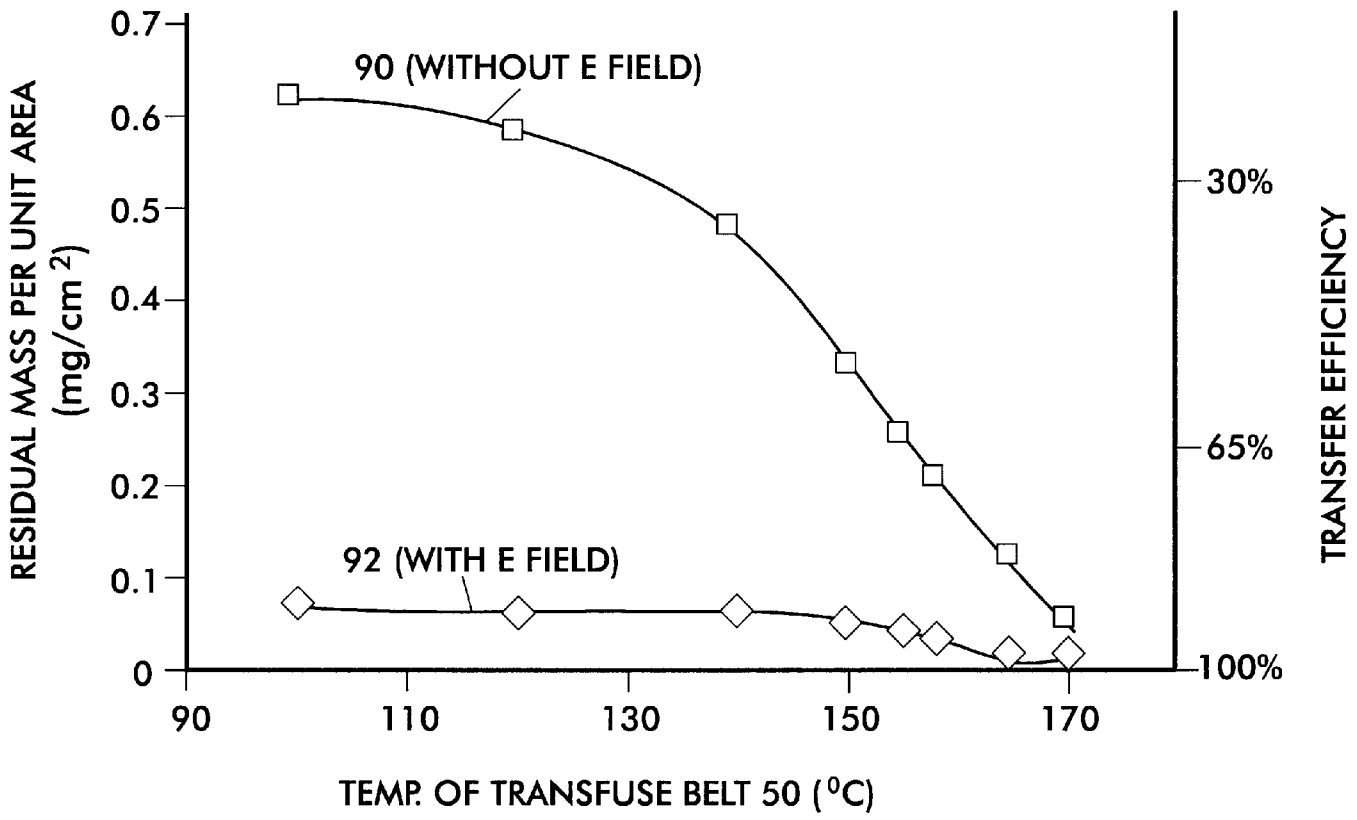
FIG. 9 is a graphical representation of residual toner as a function of transfuse member temperature.

With reference to FIG. 9 disclosing experimental data on the amount of residual toner left on the intermediate transfer member 12 as a function of the transfuse member 50 temperature. Curve 90 is with electric field, pressure and heat assist and curve 92 is without electric field assist but with pressure and heat assist. A very low amount of residual toner means very high transfer efficiency. The toner used in the experiments has a glass transition temperature range Tg of around 55° C. Substantial heat assist is observed at temperatures of the transfuse member 50 above Tg. Substantially 100% toner transfer occurs when operating with an applied field and with the transfuse member 50 temperature above around 165° C., well above the range of the toner Tg. Preferential temperatures will vary depending on toner properties. In general, operation well above the Tg is found to be advantageous for the heat assist to the electrostatic transfer for many different toners and system conditions.

Too high a temperature of the transfuse member 50 in the second transfer nip 48 can cause problems due to unacceptably high toner softening on the intermediate transfer member side of the composite toner layer. Thus the temperature of the transfuse member 50 prior to the second transfer nip 48 must be controlled within an optimum range. The optimum temperature of the composite toner image in the second transfer nip 48 is less than the optimum temperature of the composite toner image in the third transfer nip 86. The desired temperature of the transfuse member 50 for heat assist in the second transfer nip 48 can be readily obtained while still obtaining the desired higher toner temperatures needed for more complete toner melting in the third transfer nip 86 by using pre-heating of the substrate 70. Transfer and fix to the substrate 70 is controlled by the interface temperature between the substrate and the composite toner image. Thermal analysis shows that the interface temperature increases with both increasing temperature of the substrate 70 and increasing temperature of the transfuse member 50.

At a generally constant temperature of the transfuse member 50 in the second and third transfer nips 48, 86, the optimum temperature for transfer in the second transfer nip 48 is controlled by adjusting the temperature of the intermediate transfer member 12, and transfuse in the third transfer nip 86 is optimized by preheating of the substrate 70. Alternatively, for some toner formulations or operation regimes no preheating of the substrate 70 is required.

The substrate 70 is transported, and registered by a material feed and registration system 69, into a substrate pre-heater 73. The substrate pre-heater 73 is preferably formed a transport belt transporting the substrate 70 over a heated platen. Alternatively the substrate pre-heater 73 can be formed of heated rollers forming a heating nip therebetween. The substrate 70 after heating by the substrate preheater 73 is directed into the third transfer nip 86.

Figure 10:
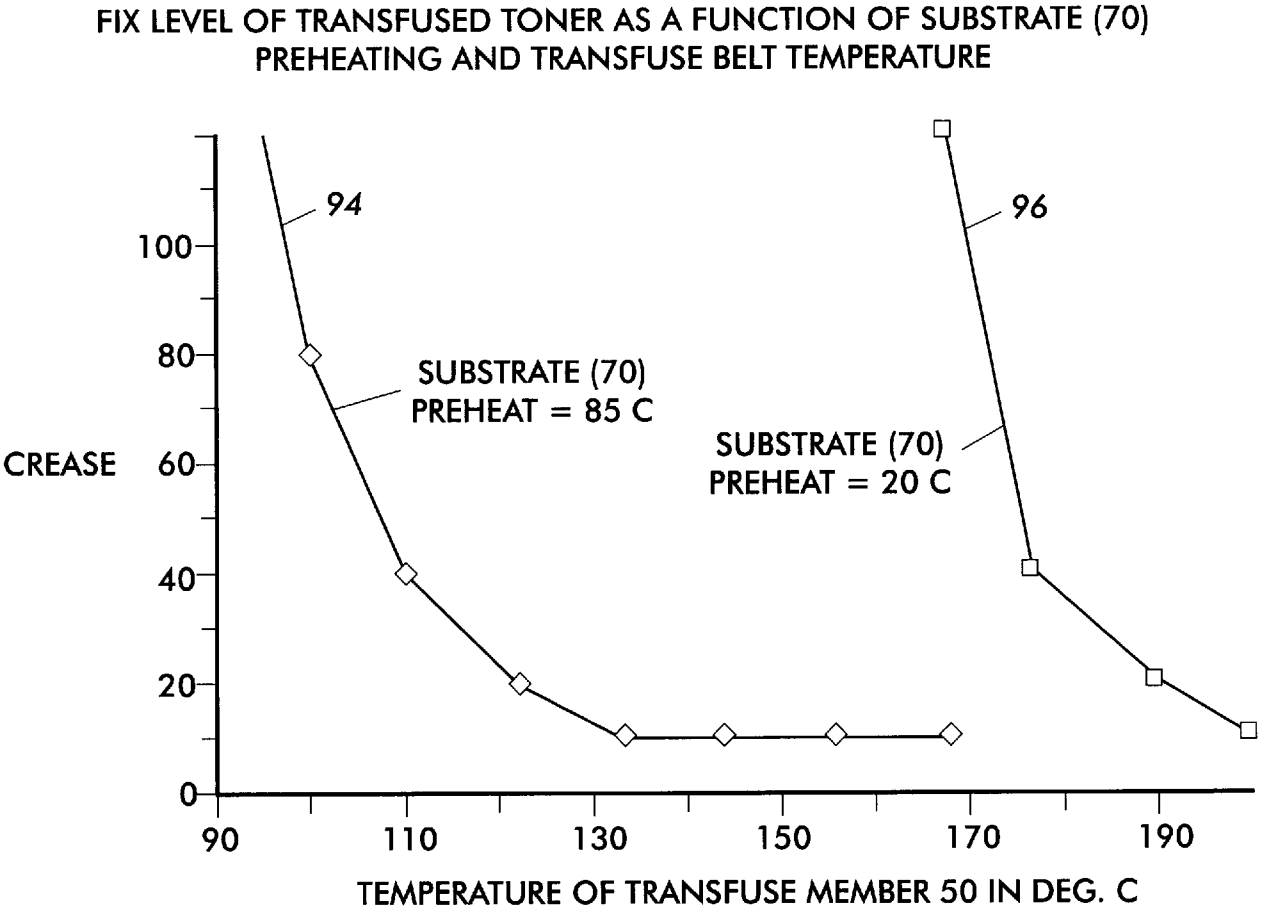
FIG. 10 is a graphical representation of crease as a function of transfuse member temperature for given representation of residual substrate temperature.

FIG. 10 discloses experimental curves 94, 96 of a measure of fix called crease as a function of the temperature of the transfuse member 50 for different pre-heating temperatures of a substrate. Curve 94 is for a preheated substrate and a curve 96 for a substrate at room temperature. The results disclose that the temperature of the transfuse member 50 for similar fix level decreases significantly at higher substrate pre-heating curve 94 compared to lower substrate pre-heating curve 96. Heating of the substrate 70 by the substrate pre-heater 73 prior to the third transfer nip 86 allows optimization of the temperature of the transfuse member 50 for improved transfer of the composite toner image in the second transfer nip 48. The temperature of the transfuse member 50 can thus be controlled at the desired optimum temperature range for optimum transfer in the second transfer nip 48 by controlling the temperature of the substrate 70 at the corresponding required elevated temperature needed to create good fix and transfer to the substrate 70 in the third transfer nip 86 at this same controlled temperature of the transfuse member 50. Therefore cooling of the transfuse member 50 prior to the second transfer nip 48 is not required for optimum transfer in the second transfer nip 48. In other words the transfuse member 50 can be maintained at substantially the same temperature in both the second and third transfer nips 48, 86.

Furthermore, the over layer, the intermediate and topmost layers, of the transfuse member 50 can be relatively thick, preferably greater than about 1.0 mm, because no substantial cooling of the transfuse member 50 is required prior to the second transfer nip 48. Relatively thick intermediate and topmost layers of the transfuse member 50 allows for increased conformability. The increased conformability of the transfuse member 50 permits printing to a wider latitude of substrates 70 without a substantial degradation in print quality. In other words the composite toner image can be transferred with high efficiency to relatively rough substrates 70.

In addition, the transfuse member 50 is preferably at substantially the same temperature in both the second and third transfer nips 48, 86. However, the composite toner image preferably has a higher temperature in the third transfer nip 86 relative to the temperature of the composite toner image in the second transfer nip 48. Therefore the substrate 70 has a higher temperature in the third transfer nip 86 relative to the temperature of the intermediate transfer member 12 in the second transfer nip 48. Alternatively, the transfuse member 50 can be cooled prior to the second transfer nip 48, however the temperature of the transfuse member 50 is maintained above, and preferably substantially above the Tg of the composite toner image. Furthermore, under certain operating conditions, the top surface of the transfuse member 50 can be heated just prior to the second transfer nip 48.

The composite toner image is transferred and fused to the substrate 70 in the third transfer nip 86 to form a completed document 72. Heat in the third transfer nip 86 from the substrate 70 and transfuse member 50, in combination with pressure applied by the pressure roller 84 acting against the guide roller 76 transfer and fuse the composite toner image to the substrate 70. The pressure in the third transfer nip 86 is preferably in the range of about 40 psi to 500 psi, and more preferably in the range 60 psi to 200 psi. The transfuse member 50, by combination of the pressure in the third transfer nip 86 and the appropriate durometer of the transfuse member 50 induces creep in the third transfer nip to assist release of the composite toner image and substrate 70 from the transfuse member 50. Preferred creep is greater than 4%. Stripping is preferably further assisted by the positioning of the guide roller 78 relative to the guide roller 76 and pressure roller 84. The guide roller 78 is positioned to form a small amount of wrap of the transfuse member 50 on the pressure roller 84. The geometry of the guide rollers 76, 78 and pressure roller 84 form the third transfer nip 86 having a high pressure zone and an adjacent low pressure zone in the process direction. The width of the low pressure zone is preferably one to three times, or more preferably about two times the width of the high pressure zone. The low pressure zone effectively adds an additional 2–3% creep and thereby improves stripping. Additional stripping assistance can be provided by stripping system 87, preferably an air puffing system. Alternatively the stripping system 87 can be a stripping blade or other well known systems to strip documents from a roller or belt. Alternatively, the pressure roller can be substituted with other pressure applicators such as a pressure belt.

After stripping, the document 72 is directed to a selectively activatable glossing station 110 and thereafter to a sheet stacker or other well know document handing system (not shown). The printer 10 can additionally provide duplex printing by directing the document 72 through an inverter 71 where the document 72 is inverted and reintroduced to the pre-transfer heating station 73 for printing on the opposite side of the document 72.

A cooling station 66 cools the intermediate transfer member 12 after second transfer nip 48 in the process direction. The cooling station 66 preferably transfers a portion of the heat on the intermediate transfer member 12 at the exit side of the second transfer nip 48 to a heating station 64 at the entrance side of the second transfer nip 48. Alternatively the cooling station 66 can transfer a portion of the heat on the intermediate transfer member 12 at the exit side of the second transfer nip 48 to the substrate prior to the third transfer nip 86. Alternatively the heat sharing can be implemented with multiple heating stations 64 and cooling stations 66 to improve heat transfer efficiency.

A cleaning station 54 engages the intermediate transfer member 12. The cleaning station 54 preferably removes oil that may be deposited onto the intermediate transfer member 12 from the transfuse member 50 at the second transfer nip. For example, if a preferred silicone top most layer is used for the transfuse member 50, some silicone oil present in the silicone material can transfer from the transfuse member 50 to the intermediate transfer member 12 and eventually contaminate the image bearing members 30. In addition the cleaning station 54 removes residual toner remaining on the intermediate transfer member 12. The cleaning station 54 also cleans oils deposited on the transfuse member 50 by the release agent management system 88 that can contaminate the image bearing members 30. The cleaning station 54 is preferably a cleaning blade alone or in combination with an electrostatic brush cleaner, or a cleaning web.

A cleaning system 58 engages the surface of the transfuse member 50 past the third transfer nip 86 to remove any residual toner and contaminants from the surface of the transfuse member 50. Preferably the cleaning system 58 includes a cleaning roller having a sticky surface created by partially melted toner. The cleaning roller is preferably heated by the transfuse member 50 to thereby maintain the toner on the cleaning roller in a partially melted state. The operating temperature range is sufficiently high to melt the toner, but sufficiently low to prevent toner layer splitting. The partially melted toner is maintained within the optimum temperature range for cleaning by the temperature of the transfuse member 50 in combination with any necessary heating or cooling of the cleaning roller.

The transfuse member 50 is driven in the cyclical path by the pressure roller 84. Alternatively drive is provided or enhanced by driving guide roller 74. The intermediate transfer member 12 is preferably driven by the pressured contact with the transfuse member 50. Drive to the intermediate transfer member 12 is preferably derived from the drive for the transfuse member 50, by making use of adherent contact between intermediate transfer member 12 and the transfuse member 50. The adherent contact causes the transfuse member 50 and intermediate transfer member 12 to move in synchronism with each other in the second transfer nip 48. Adherent contact between the intermediate transfer member 12 and the toner image producing stations 22, 24, 26, 28 may be used to ensure that the intermediate transfer member 12 moves in synchronism with the toner image producing stations 22, 24, 26, 28 in the first transfer zones 40. Therefore the toner image producing stations 22, 24, 26, 28 can be driven by the transfuse member 50 via the intermediate transfer member 12. Alternatively, the intermediate transfer member 12 is independently driven. When the intermediate transfer member is independently driven, a motion buffer (not shown) engaging the intermediate transfer member 12 buffers relative motion between the intermediate transfer member 12 and the transfuse member 50. The motion buffer system can include a tension system with a feedback and control system to maintain good motion of the intermediate transfer member 12 at the first transfer nips 40 independent of motion irregularity translated to the intermediate transfer member 12 at the second transfer nip 48. The feedback and control system can include registration sensors sensing motion of the intermediate transfer member 12 and/or sensing motion of the transfuse member 50 to enable registration timing of the transfer of the composite toner image to the substrate 70.

Figure 3:
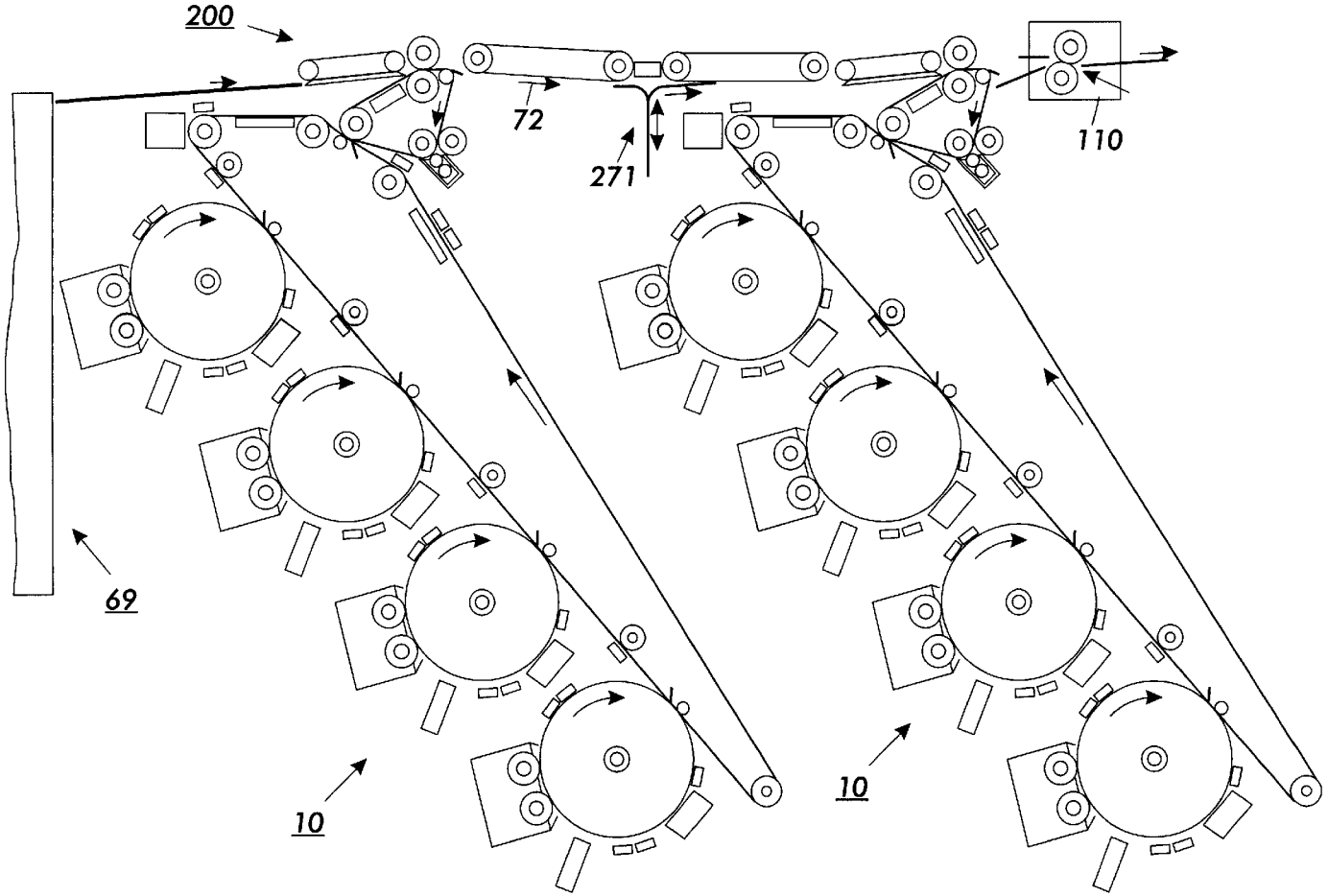
FIG. 3 is a schematic side view of a tandem cut sheet duplex electrostatographic printer in accordance with the invention.

A duplex printer 200 provides full speed duplex printing of documents 72 (see FIG. 3). The duplex printer 200 is formed of first and second printers 10 arranged in tandem and operationally connected by a document inverter 271. The document inverter receives individual documents 72 from the first printer 10, inverts the documents 72 and directs them to the second printer 10 to receive additional printing.

Figure 4:
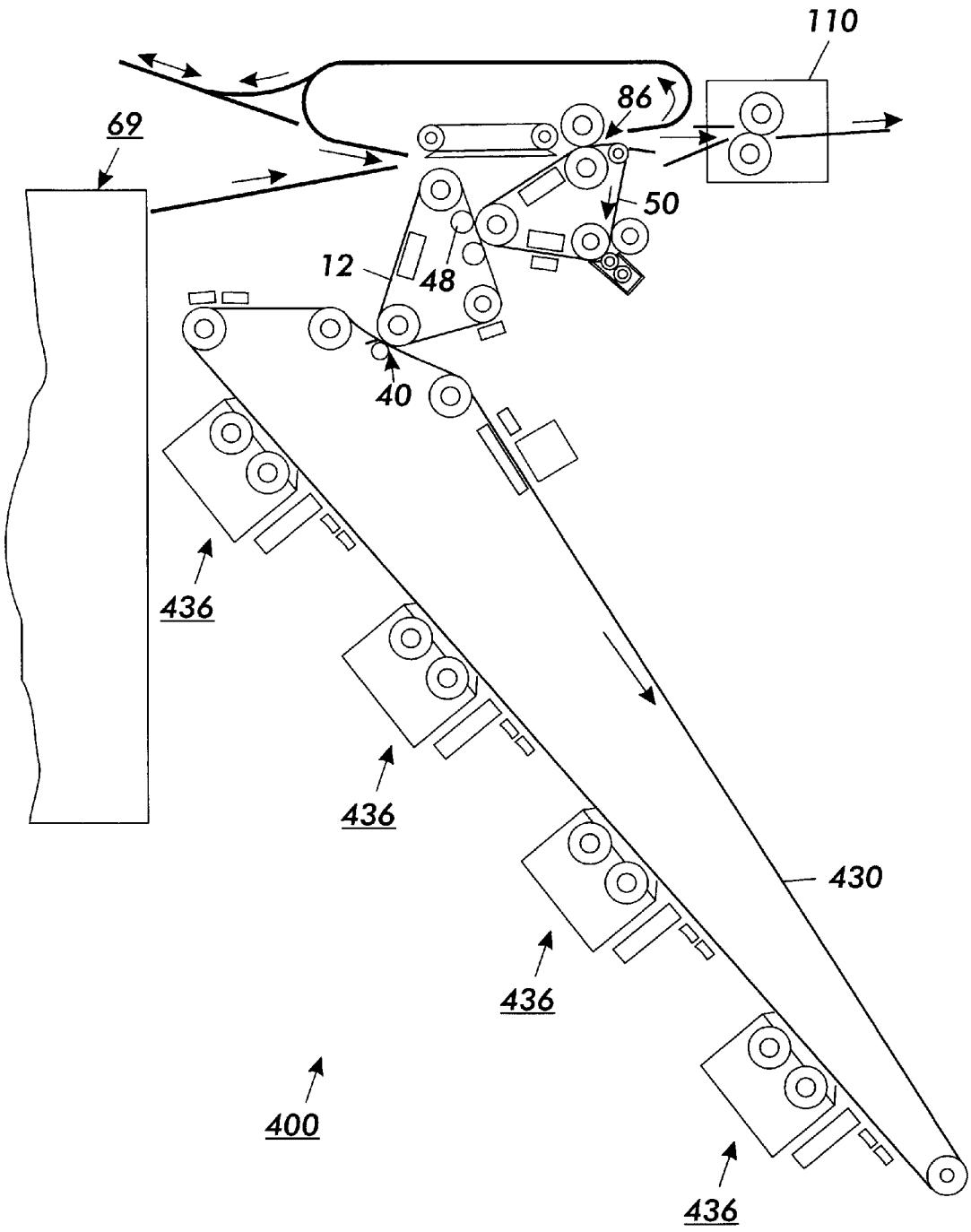
FIG. 4 is a schematic side view of a cut sheet duplex printer in accordance with the invention having a single photoconductor employing an image-on-image process.
Figure 5:
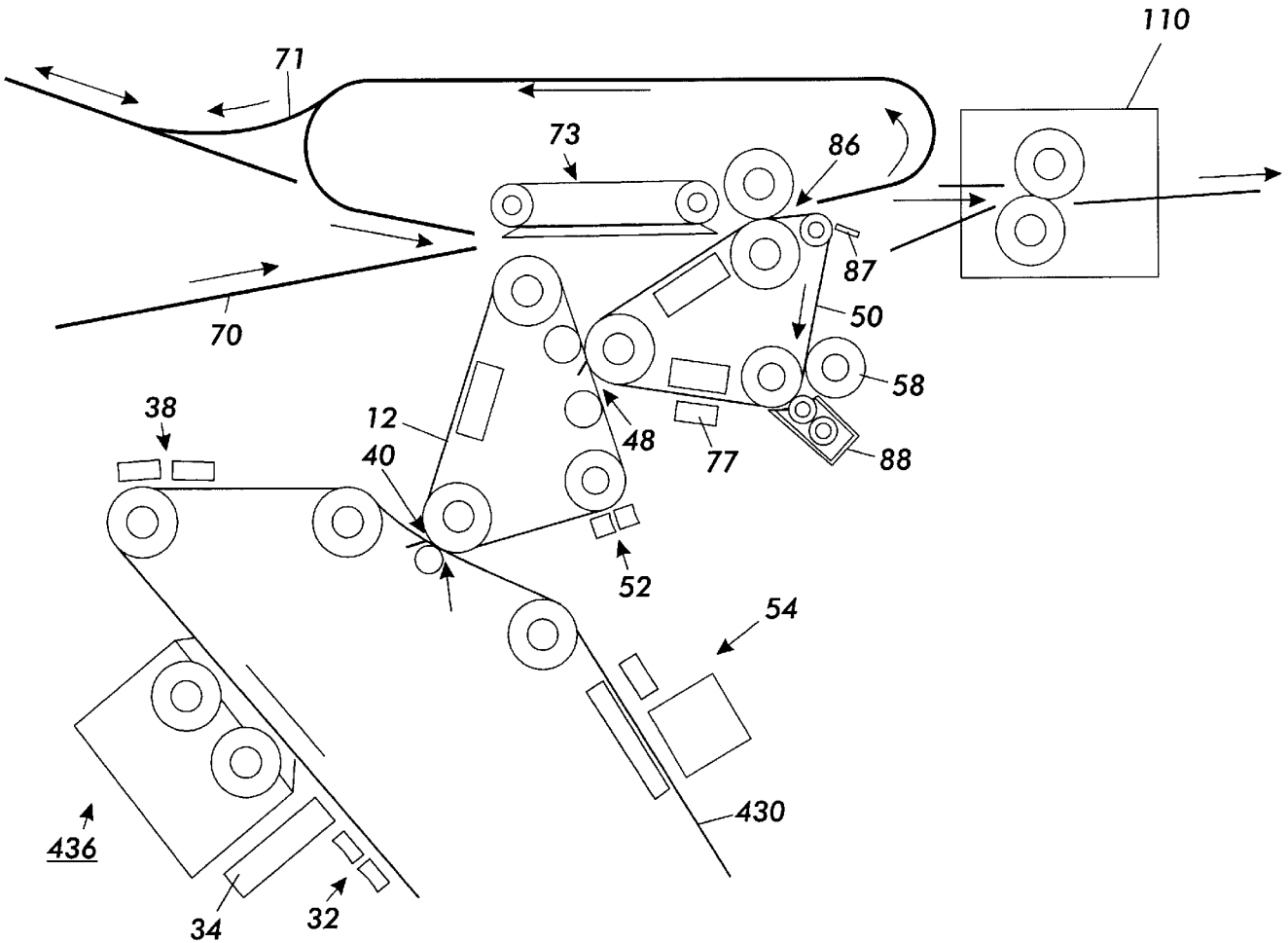
FIG. 5 is an enlarged schematic side view of the transfer nips of the printer of FIG. 4.

In a further electrostatographic image-on-image printer 400, the composite toner image is formed on a single image bearing member 430 by an image-on-image (IOI) process (see FIGS. 4 and 5). Multiple developer stations 436 serially develop component toner images on the image bearing member 430. The developer stations 436 are preferably scavengless so as not to disturb previously transferred component toner images on the image bearing member 430. Between developer stations 436 the image bearing member is recharged, re-exposed, and developed to build up the composite toner image. The composite toner image is transferred in the first transfer nip 40 to the intermediate transfer member 12 and processed as described above.

Figure 6:
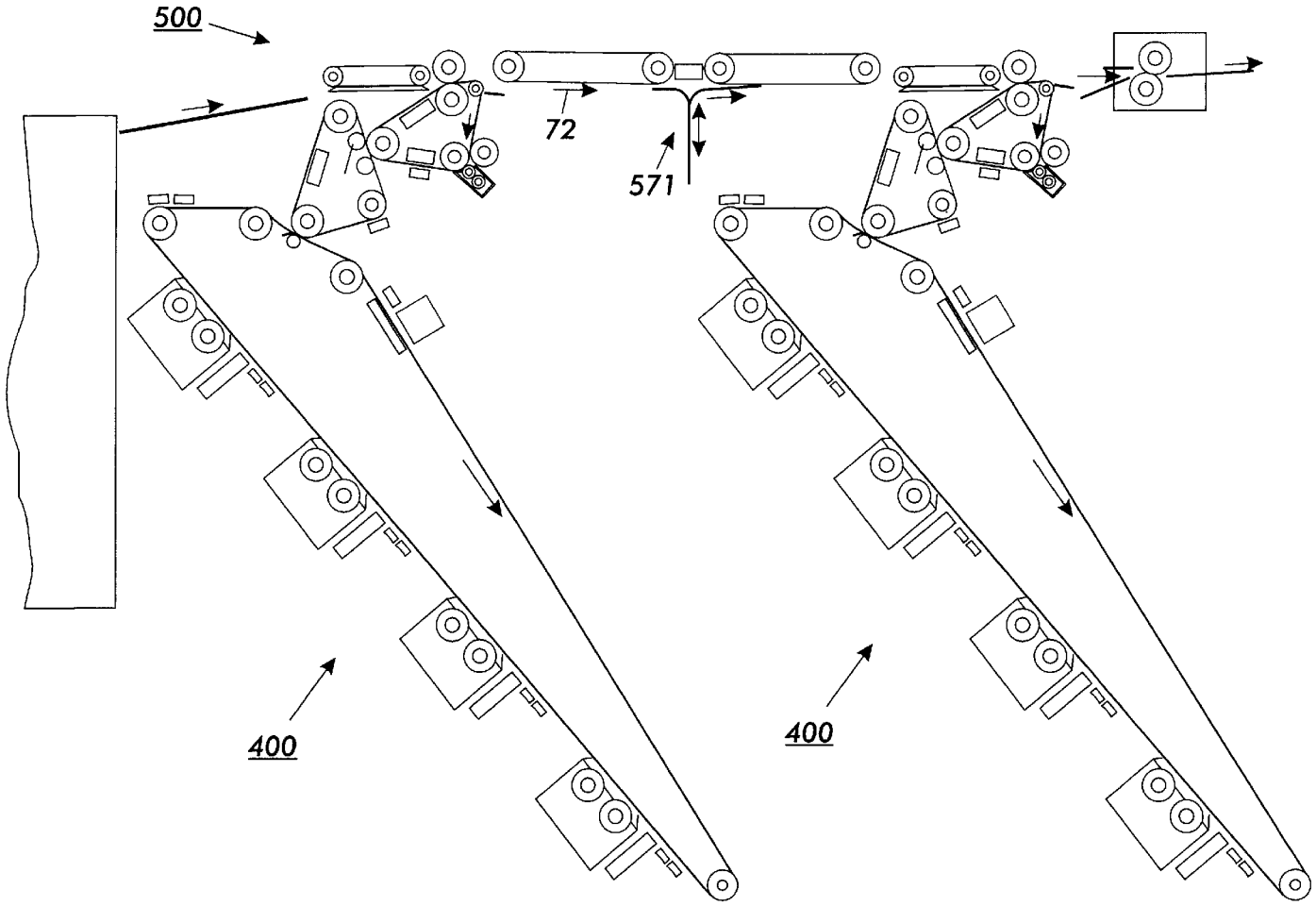
FIG. 6 is a schematic side view of a tandem cut sheet duplex printer in accordance with the invention, having tandem photoreceptors, each using an image-on-image processing.

A duplex image-on-image printer 500 provides full speed duplex printing of documents 72 (see FIG. 6). The image-on-image duplex printer 500 is formed of first and second image-on-image printers 400 arranged in tandem and operationally connected by a document inverter 571. The document inverter receives individual documents 72 from the first image-on-image printer 400, inverts the documents 72 and directs them to the second image-on-image printer 400 to receive additional printing.

Figure 7:
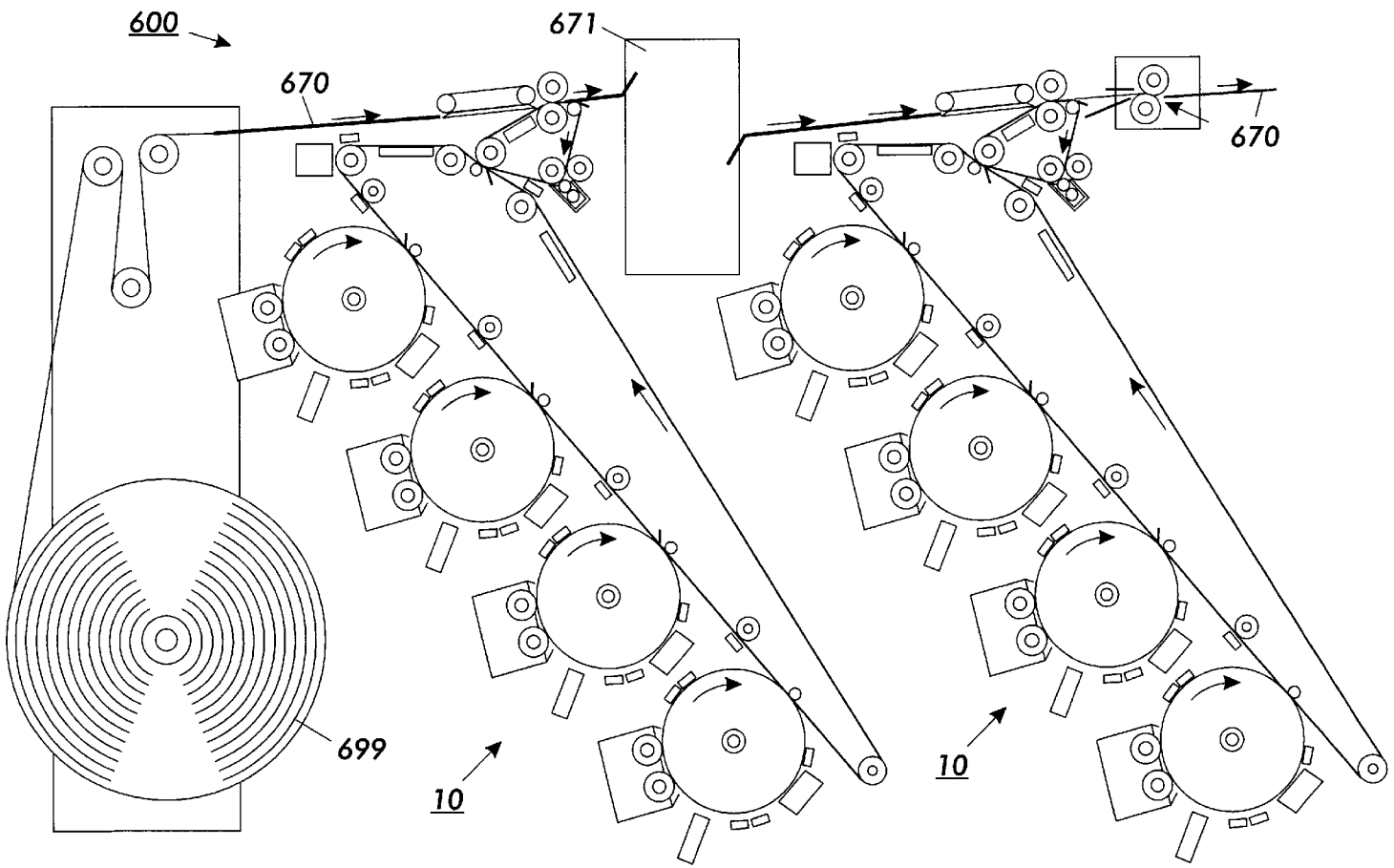
FIG. 7 is a schematic side view of a web substrate duplex electrostatographic printer in accordance with the invention.

A duplex web printer 600 employs a first and second printer 10 arranged in tandem to print on a continuous web 670 (see FIG. 7). The web 670 is fed from a material feed and registration system 669 into the first printer 10. The web 670 is directed from the first printer 10 to a web inverter 671 for inversion prior to being directed into the second printer 10. The web inverter 671 also buffers the web between the first and second printers 10 to compensate for differential print speeds. After the second printer 10, the web 670 is directed to sheet cutters or other well known document handling systems.

Figure 8:
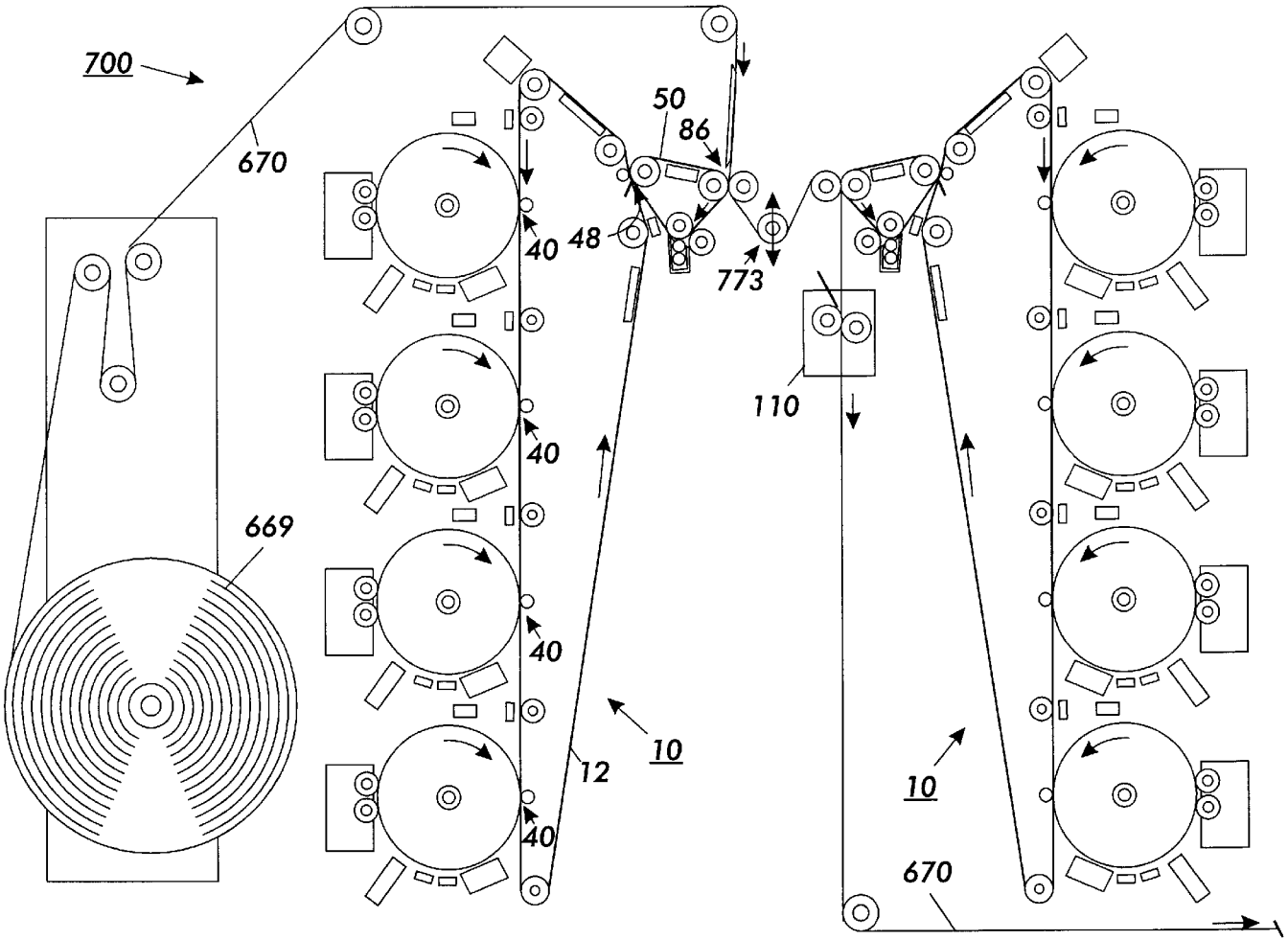
FIG. 8 is a schematic side view of a web substrate duplex electrostatographic printer in accordance with the invention.

A duplex web printer 700 employs a first and second printers 10 arranged in tandem to print on a continuous web 670 (see FIG. 8). The second printer 10 is arranged in generally mirror image orientation to the first printer 10. The web 670 is fed from a material feed and registration system 669 into the first printer 10. The web 670 is then directed from the first printer to the second printer 10. The second printer 10 employs a substrate pre-heater 773. The substrate pre-heater 773 employs a movable heated roller to heat and buffer the web prior to the third transfer nip 86 of the second printer 10. After the second printer 10, the web 670 is directed to sheet cutters or other well known document handling systems.

A gloss enhancing station 110 is preferably positioned down stream in the process direction from the third transfer nip 86 for selectively enhancing the gloss properties of documents 72. The gloss enhancing station 110 has opposed fusing members 112,114 defining a gloss nip 116 there between. U.S. Pat. No. 5,521,688, Hybrid Color Fuser, incorporated herein by reference, describes a gloss enhancing station with a radiant fuser.

The separation of fixing and glossing functions provides operational advantages. Separation of the fixing and glossing functions permits operator selection of the preferred level of gloss on the document 72. The achievement of high gloss performance for color systems generally requires relatively higher temperatures in the third transfer nip 86. It also typically requires materials on the transfuse member 50 having a higher heat and wear resistance such as Viton™ to avoid wear issues that result in differential gloss caused by changes in surface roughness of the transfuse member due to wear. The higher temperature requirements and the use of more heat and wear resistant materials generally results in the need for high oil application rates by their lease agent management system 88. In transfuse systems such as the printer 10 increased temperatures and increased amounts of oil on the transfuse member 50 could possibly create contamination problems of the photoreceptors 30. Printers having a transfuse system and needing high gloss use a thick nonconformable transfuse member, or a relatively thin transfuse member. However, a relatively nonconformable transfuse member and a relatively thin transfuse member fail to have the high degree of conformance needed for good printing on, for example, rougher paper stock.

The use of the gloss enhancing station 110 substantially reduces or eliminates the need for gloss creation in the third transfer nip 86. The reduction or elimination of the need for gloss in the third transfer nip 86 therefore minimizes surface wear issues for color transfuse member materials and enables a high life transfuse member 50 with readily available silicone or other similar soft transfuse member materials. It allows the use of relatively thick layers on the transfuse member 50 with resultant gain in operating life for the transfuse member materials and with resultant high conformance for imaging onto rougher substrates. It reduces the temperature requirements for the transfuse materials set with further gain in transfuse material life, and it can substantially reduce the oil requirements in the third transfer nip 86.

The gloss enhancing station 110 is preferably positioned sufficiently close to the third transfer nip 86, so the gloss enhancing station 110 can utilize the increased document temperature that occurs in the third transfer nip 86. The increased temperature of the document 72 reduces the operating temperature needed for the gloss enhancing station 110. The reduced temperature of the gloss enhancing station 110 improves the life and reliability of the gloss enhancing materials.

Use of a highly conformable silicone transfuse member 50 is an example demonstrated as one important means for achieving good operating fix latitude with low gloss. Critical parameters are sufficiently low durometer for the top most layer of the transfuse member 50, preferably of rubber, and relatively high thickness for the intermediate layers of the transfuse member 50, preferably also of rubber. Preferred durometer ranges will depend on the thickness of the composite toner layer and the thickness of the transfuse member 50. The preferred range will be about 25 to 55 Shore A, with a general preference for about 35 to 45 Shore A range. Therefore preferred materials include many silicone material formulations. Thickness ranges of the over layer of the transfuse member 50 will preferably be greater than about 0.25 mm and more preferably greater than 1.0 mm. Preference relative to low gloss will be for generally thicker layers to enable extended toner release life, conformance to rough substrates, extended nip dwell time, and improved document stripping. In an optional embodiment a small degree of surface roughness is introduced on the surface of the transfuse member 50 to enhance the range of allowed transfuse material stiffness for producing low transfuse gloss. Especially with higher durometer materials and/or low thickness layers there will be a tendency to reproduce the surface texture of the transfuse member. Thus some surface roughness of the transfuse member 50 will tend toward low gloss in spite of high stiffness. Preference will be transfuse member surface gloss number <30 GU.

A narrow operating temperature latitude for good fix with low gloss in transfuse has been demonstrated at relatively high toner mass/area conditions. Toner of size about 7 microns requiring toner masses about 1 mg/cm2 requires a temperature of the transfuse member 50 between 110–120C. and preheating of the paper to about 85C. to achieve gloss levels of <30 GU while simultaneously achieving acceptable crease level below 40. However, low mass/area toner conditions have shown increased operating transfuse system temperature range for fix and low gloss. The use of small toner having high pigment loading, in combination with a conformable transfuse member 50, allows low toner mass/area for color systems therefore extending the operating temperature latitude for low gloss in the third transfer nip 86. Toner of size about 3 microns requiring toner masses about 0.4 mg/cm2 requires a temperature of the transfuse member 50 between 110–150C., and paper preheating to about 85C., to achieve gloss levels of <30 GU while simultaneously achieving acceptable crease level below 40.

The gloss enhancing station 110 preferably has fusing members 112, 114 of Viton™. Alternatively hard fusing members such as thin and thick Teflon™ sleeves/over coatings on rigid rollers or on belts, or else such over coatings over rubber underlayers, are alternative options for post transfuse gloss enhancing. The fusing members 112, 114, preferably have an top most fixing layer stiffer than that used for the top most layer of the transfuse member 50, with a high level of surface smoothness (surface gloss preferably>50 GU and more preferably >70 GU). The gloss enhancing station 110 preferably includes a release agent management application system (not shown). The gloss enhancing station can further include stripping mechanisms such as an air puffer to assist stripping of the document 72 from the fusing members 112, 114.

Optionally the toner formulation may include wax to reduce the oil requirements for the gloss enhancing station 110.

The gloss enhancing station 110 is described in combination with the printer 10 having an intermediate transfer member 12 and a transfuse member 50. However, the gloss enhancing station 110 is applicable with printers having transfuse systems producing documents with low gloss. In particular this can include transfuse systems that employ a single intermediate transfer/transfuse member.

As a system example, the transfuse member 50 is preferably 120 C. in the third transfer nip 86, and the substrate 70 is preheated to 85 C. The result is a document 72 having a gloss value 20–30 GU. The fusing members 112, 114 are preferably fusing rollers, but can alternatively the fusing members 112, 114 can be fusing belts. The top most surface of each fusing member 112, 114 is relatively non-conformable, preferably having a durometer above 55 Shore A. The gloss enhancing station 110 provides gloss enhancing past the printer 10 employing a transfuse system that operates with low gloss in the third transfer nip 86. The printer 10 preferably forms documents 72 having 10–30 Gardner Gloss Units (GU) after the third transfer nip 86. The gloss on the documents 72 will vary with toner mass per unit area. The gloss enhancing unit 110 preferably increases the gloss of the documents 72 to greater than about 50 GU on Lustro Gloss™ paper distributed by S D Warren Company.

What is claimed is:

1. A printing apparatus comprising:

a toner image producing station for forming a toner image having a glass transition temperature and having an image bearing member for supporting said toner image;

a transfuse station for generally simultaneously transferring and fusing said toner image to a substrate and having a transfuse member for supporting said toner image; and an intermediate transfer member for transporting said toner image between said image bearing member and said transfuse member, and forming a first transfer nip with said image bearing member for transfer of said toner image, and a second transfer nip with said transfuse member for transfer of said toner image, said transfuse member in said second transfer nip above said glass transition temperature of said toner image and said intermediate transfer member below said glass transmission temperature of said toner image.

2. The printing apparatus of claim 1 wherein said toner image defines an average temperature in said second transfer nip and said transfuse station has a pressure member defining a third transfer nip with said transfuse member for said transferring and fusing said toner image to said substrate, said toner image in said third transfer nip having an average temperature greater than said average temperature of said toner image in said second transfer nip.

3. The printing apparatus of claim 2 wherein said transfuse member has substantially the same temperature in said second transfer nip and said third transfer nip.

4. The printing apparatus of claim 3 further comprising a substrate heating station heating said substrate above room temperature prior to said third transfer nip.

5. The printing apparatus of claim 3 wherein said intermediate transfer member defines a temperature prior to said second transfer nip and said substrate defines a temperature prior to said third transfer nip greater than said temperature of said intermediate transfer member.

6. The printing apparatus of claim 1 where in said temperature of said transfuse member in said second transfer nip is about greater than 90 C.

7. The printing apparatus of claim 1 wherein said transfuse member is a belt having a back layer and an over layer, said over layer having a thickness about greater than 0.25 mm.

8. The printing apparatus of claim 7 wherein said over layer is greater than about 1.0 mm.

9. The printing apparatus of claim 1 wherein said transfuse member has multiple layers including a top most layer, said top most layer selected from the group of fluoropolymers and fluoroelastomers.

10. The printing apparatus of claim 1 wherein said transfuse member has multiple layers including a top most layer, said top most layer comprising silicone.

11. The printing apparatus of claim 1 wherein said transfuse member has a durometer rating of about 35–55 Shore A.

12. A method for forming a printed document comprising:

forming a toner image having a glass transition temperature on an image bearing member;

defining a first transfer nip with said image bearing member and an intermediate transfer member;

transferring said toner image at said first transfer nip to said intermediate transfer member having a temperature below said glass transmission temperature of said toner image;

forming a second transfer nip between said intermediate transfer member and a transfuse member;

transferring said toner image at said second transfer nip to said transfuse member, said transfuse member at a temperature above the glass transition temperature of said toner image at said second transfer nip;

defining a third transfer nip with said transfuse member and a pressure member;

transferring said toner image at said third transfer nip to a substrate; and fusing said toner image to said substrate, generally simultaneously with said transferring said toner image to said substrate, to form a document.

13. The method of claim 12 wherein said transfer of said toner image at said second transfer nip is electrostatic and heat assisted.

14. The method of claim 13 wherein said transfer of said toner image at said third transfer nip is non-electrostatic with heat and pressure.

15. The method of forming a document of claim 14 wherein said transfer of said toner image in said first transfer nip is electrostatic.

16. The method of forming a document of claim 12 wherein said transfer of said toner image in said first transfer nip is electrostatic.

17. The method of claim 12 wherein said transfuse member has substantially the same temperature at the second and third transfer nips.

18. The method of claim 14 further comprising heating the substrate above room temperature prior to said third transfer nip.

19. A printing apparatus comprising:

a toner image producing station for forming a toner image having a glass transition temperature and having an image bearing member for supporting said toner image;

a transfuse station for generally simultaneously transferring and fusing said toner image to a substrate and having a transfuse member having a durometer rating of about 35–55 shore A for supporting said toner image; and an intermediate transfer member for transporting said toner image between said image bearing member and said transfuse member, and forming a first transfer nip with said image bearing member for transfer of said toner image, and a second transfer nip with said transfuse member for transfer of said toner image, said transfuse member in said second transfer nip above said glass transition temperature of said toner image and said intermediate transfer member below said glass transmission temperature of said toner image.

* * * * *